United States Patent [19]

Ikio

[11] 4,198,274

[45] Apr. 15, 1980

[54] DOOR FOR A COKE OVEN FURNACE

[75] Inventor: Kazumi Ikio, Kita-Kyushu, Japan

[73] Assignee: Ikio Iron Works Co., Ltd., Japan

[21] Appl. No.: 856,517

[22] Filed: Feb. 2, 1978

[51] Int. Cl.[2] ..... C10B 25/06; C10B 25/16

[52] U.S. Cl. ..... 202/248; 202/268; 202/269

[58] Field of Search ..... 202/268, 269, 248

[56] References Cited

U.S. PATENT DOCUMENTS

| | | | |
|---|---|---|---|
| 2,209,590 | 7/1940 | Wilputte | 202/248 |
| 2,442,348 | 6/1948 | Exum | 202/248 |
| 2,478,215 | 8/1949 | Van Ackeren | 202/248 |
| 2,601,631 | 6/1952 | Reintjes | 202/268 |
| 2,641,575 | 6/1953 | Otto | 202/268 |
| 4,086,231 | 4/1978 | Ikio | 202/248 |

FOREIGN PATENT DOCUMENTS

| | | | |
|---|---|---|---|
| 2548923 | 5/1976 | Fed. Rep. of Germany | 202/248 |

*Primary Examiner*—Joseph Scovronek
*Assistant Examiner*—Bradley Garris
*Attorney, Agent, or Firm*—McGlew and Tuttle

[57] ABSTRACT

A coke oven door construction for closing and opening in a coke oven furnace comprising a brick supporter for carrying bricks in the coke oven furnace opening which is subject to high temperatures in the coke oven furnace and thermal expansion, and a door body connected to the brick supporter and having a locking mechanism for retaining the brick supporter in the coke oven furnace opening. The door body and brick supporter are elongated and rigidly connected to each other by at least one connecting pin at one elevation along the door body and brick supporter. The door body and brick supporter are also connected to each other by a plurality of sliding connections along the length of the door body and brick supporter whereby longitudinal thermal expansion of the brick supporter is not transmitted to the door body so that the door body and brick supporter are not warped by such thermal expansion.

2 Claims, 5 Drawing Figures

DOOR FOR A COKE OVEN FURNACE

BACKGROUND OF THE INVENTION

Field of the Invention

The present invention relates in general to a coke oven furnace construction, and more particularly to a coke oven door used to seal the opening of a coke oven furnace.

Prior to the present invention the door body of a coke oven door that includes a locking mechanism and which is situated outside and in front of a coke oven furnace opening, and the brick supporter which carries bricks that are directly subject to extremely high temperatures in the coke oven furnace opening have been integrally constructed and secured directly to each other by means of bolt or the like.

There are generated great differences in temperature between the brick supporter, which is subject to such extremely high temperatures as 800° C. to 1110° C., and the door body, so that the door body tends to bend or distort outwardly due to heat expansion.

It is a disadvantage of this construction that this phenomenon often prevents the opening of the coke oven furnace from being firmly sealed by means of the door. Crevices are produced between the door and the opening of the coke oven furnace so that gas or tar are leaked, resulting in air pollution. Another disadvantage of this construction is that to prevent these leaks it is often necessary to adjust knife edges provided on the door body which seal the body to the coke oven furnace.

SUMMARY OF THE INVENTION

According to the present invention the bricks and supporters are separated from the door body in order to prevent these from interrupting and distorting each other due to differences in heat expansion.

Such a construction makes it possible for the bricks and supporters which are subject to extremely high temperatures not to directly afftect the door body though they themselves extend, so that the door door body will not be distorted or bent.

A conventional door for a coke oven furnace has been made in general of such large-sized and thick material so that it has a high stiffness in order to prevent the door body from being distorted due to heat expansion, and to increase bearing stresses. The total weight and size of the door thus often becomes increased to an undesirable extent so that the opening, closing, attaching and detaching operations for the door become difficult. Large-sized door lifters are also needed due to the great size. According to the present invention, it is not necessary to strengthen the door body, unlike in conventional ones, so that a light-weight door can be obtained, which enables the attaching and detaching operations to be more easily carried out.

STATEMENT OF THE OBJECTS

Thus it is an object of the present invention to provide a door for a coke oven furnace which is not distorted and does not reduce the sealing effect with the opening of a coke oven furnace.

It is another object of the present invention to provide a door for a coke oven furnace which has a reduced requirement for adjusting operations of knife edges which are provided.

It is still another object of the present invention to provide a door for a coke oven furnace which is easily attachable and detachable.

It is a further object of the present invention to provide a lightweight door for a coke oven furnace.

A still further object of the present invention is to provide a coke oven door construction which is simple in design, rugged in construction and economical to manufacture.

For an understanding of the principles of the invention, reference is made to the following description of typical embodiments thereof as illustrated in the accompanying drawings.

DESCRIPTION OF THE DRAWINGS

Referring now to the attached drawings.

GENERAL DESCRIPTION OF THE PREFERRED EMBODIMENT

Figure 1:
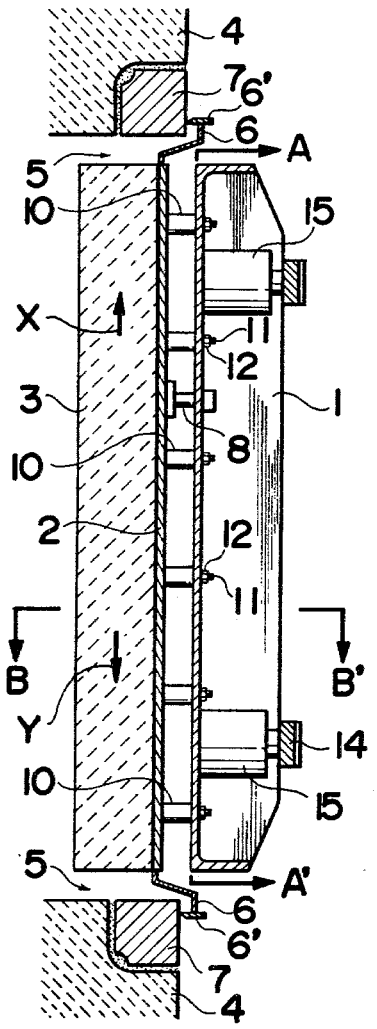
FIG. 1 is a side sectional view taken on the line C—C' of FIG. 3 showing a door for a coke oven furnace embodied in accordance with the present invention.
Figure 2:
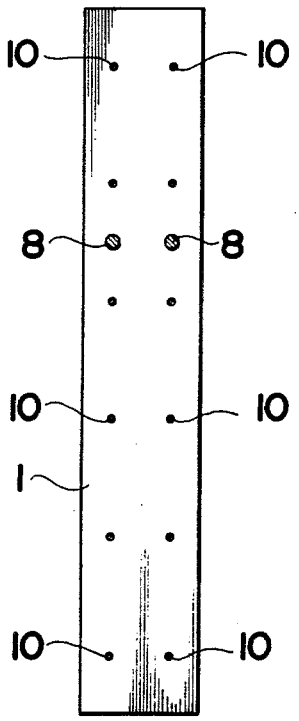
FIG. 2 is a sectional view taken on the line A—A' of FIG. 1.
Figure 3:
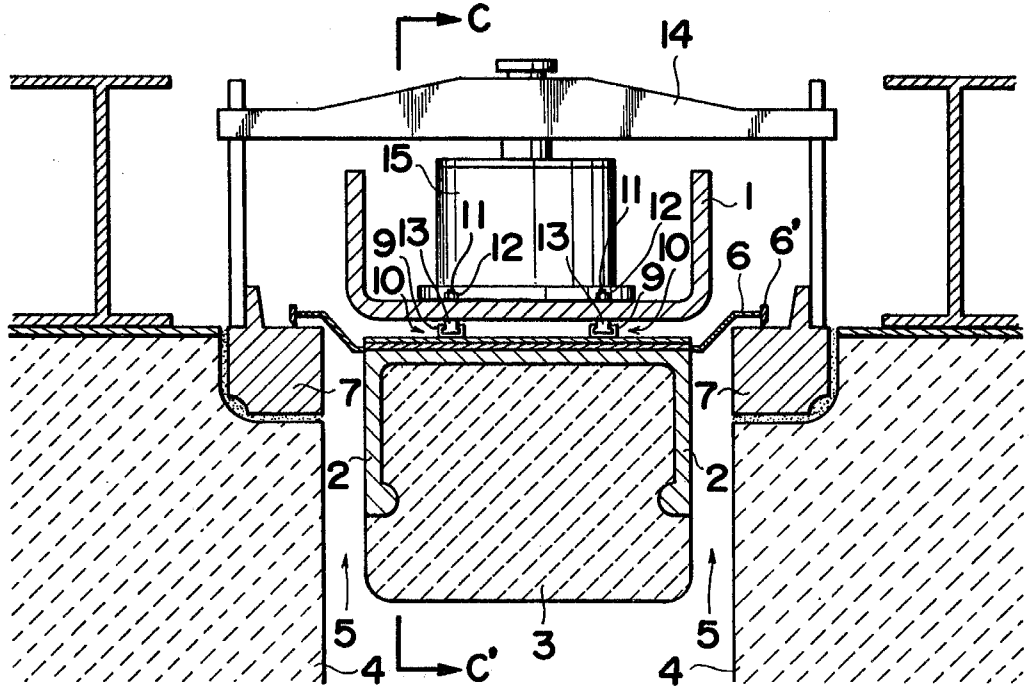
FIG. 3 is an enlarged sectional view taken on the line B—B' of FIG. 1.

In the embodiment shown in the drawing, 1 designates a door body, which is constructed of almost the same size as the opening 5 of a coke oven furnace 4, and which has a locking bar 14 and a locking bar holder 15 on the outer surface at the upper and lower portion thereof.

2 is a metallic brick supporter secured to the door body 1 and spaced therefrom, as shown in FIG. 1, by means of one or more connecting pins 8, and this brick supporter is constructed slightly smaller than the opening 5, having a brick block 3 to be situated inside the coke oven furnace 4. The brick block 3 is used sealing off high temperatures from the inside of coke oven furnace 4.

6 is a sealing plate made of stainless steel located at the periphery of the supporter 2. The sealing plate 6 includes knife edges 6' provided therearound. Each of these knife edges is in contact with a receiving frame 7 of the opening 5 of coke oven furnace 4 to seal the supporter 2 around the opening 5.

Figure 5:
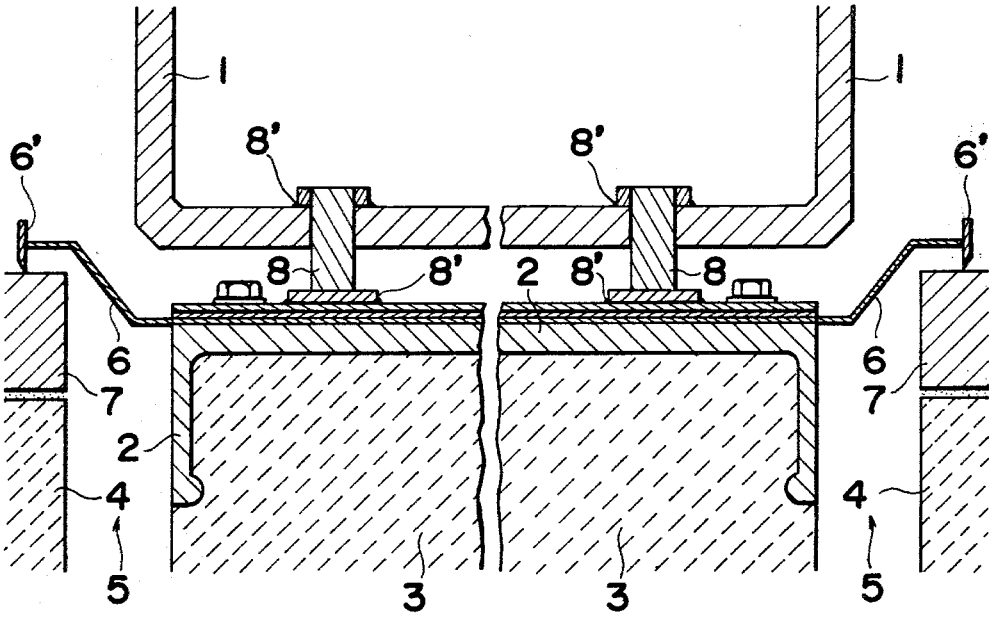
FIG. 5 is an enlarged sectional view showing the portion secured by by means of connecting pins.

In this embodiment, brick supporter 2 is secured to door body 1 by means of connecting pin 8 at welded position 8', as seen in FIG. 5 and such welding is made at the two points horizontally on door body 1 at one vertical position.

In addition, the connecting pin 8 is to be used at a higher position than the middle of door body, since in the opening 5, the higher one goes, the hotter it is so that the heat effet and heat expansion are different at the lower and upper portion while centering on connecting pin 8, thus the degree of extention due to heat also differs from each other at the lower and upper side.

Figure 4:
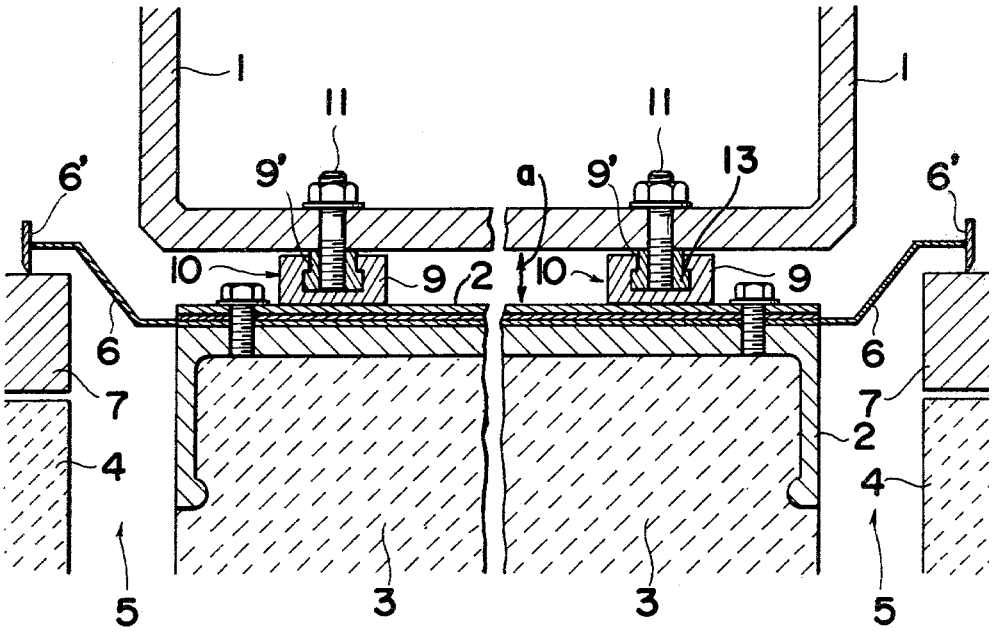
FIG. 4 is an enlarged sectional view showing the sliding mechanism portion.

9 is a guide supporter utilizable for one example as a sliding mechanism 10 provided between door body 1 and brick supporter 2 in order to maintain a certain space between the two. The guide supporter 9 is of an open channel shape and has its opening 9' facing door body 1 as seen in FIG. 4.

13 is an engaging or T-shaped body inlayed into the guide supporter 9, and fixed to door body 1 by means of bolt 11 and nut 12.

Said sliding mechanism 10 connects door body 1 with brick supporter 2 by way of space a at the upper and lower part of connecting pin 8. And said brick supporter 2 is so constructed as to extend itself in the directions indicated by the arrows X & Y as shown in FIG. 1 due to thermal forces.

According to the present invention thus composed, brick supporter 2 can be extented vertically, centering on connecting pin 8, and when said brick supporter 2 and brick block 3 are affected by extremely high temperatures in the coke oven furnace, they extend themselves vertically due to heat expansion with no effect on door body, that is, door body 1 will not be affected by heat expansion in supporter 2.

If door body 1 and supporter 2 are integrally secured and fixed, then door body 1 tends to be distorted, but according to the present invention, door body will not be bent nor distorted due to the sliding connection 10.

In addition, there is provided in the embodiment, sealing plate 6 around said brick supporter 2, and at the periphery of the former there are provided knife edges to be in contact with receiving frame 7, so that if said brick supporter 2 slides vertically, a knife edge 6' can move smoothly along the surface of receiving frame 7. And as mentioned above, said brick supporter 2 extends vertically due to heat expansion, but is little distorted, so that the tip of knife edge 6' will not discontact with the surface of receiving frame 7.

The present invention thus will perform the following effectively.

(1) There is no danger of gas or tar leakage due to sealing failure, since the present invention is capable of forming a firm sealing of the opening 5 of the coke oven furnace 4.

(2) High performance of closing or sealing of the door makes it possible to reduce or eliminate adjustment operations for knife edges.

(3) It is not necessary to increase stiffness of the door body, so that a lighter one can be available, thus resulting in obtaining a lighter and smaller-sized door lifter.

(4) There is provided a certain space a to constitute an air layer, which cuts off high temperatures inside the coke oven, and is little affected by heat.

For these reasons door body 1 will not to be distorted due to heat. Thus there is found an advantage that operational errors resulting from attaching, detaching and locking the door will disappear.

What is claimed is:

1. A coke oven door construction for closing an opening in a coke oven furnace comprising a vertically elongated brick supporter for carrying a brick block in the coke oven furnace opening which is exposed to high temperature within the coke oven furnace, a door body spaced from the brick supporter and connected thereto for carrying the brick supporter in the coke oven furnace opening, said brick supporter being subject to vertical thermal expansion of varying degree along its vertical length due to the high temperature in the coke oven furnace with higher expansion at an upper portion than at a lower portion of said brick supporter, at least one connecting pin rigidly connected between said brick supporter and said door body at one vertical location on said door body, a plurality of spaced sliding mechanisms connected between said brick supporter and said door body for providing a sliding engagement between said brick supporter and said door body, whereby vertical thermal expansion of said brick supporter is not transmitted to said door body so that said brick supporter and door body are not warped and distorted, said at least one connecting pin being connected at a vertical position above the central vertical position of said door body and brick supporter so that the thermal expansion of an upper portion of said brick supporter above said at least one connecting pin is equal to the thermal expansion of the lower portion of said brick supporter below said connecting pin, a sealing plate connected around the periphery of said brick supporter, and a knife edge connected around the periphery of said sealing plate bearing against a periphery of the coke oven furnace opening to maintain a seal between said brick supporter and the coke oven furnace opening.

2. A coke oven door according to claim 1, wherein said sliding mechanism comprises an open channel-shaped member connected to said brick supporter and a T-shaped member connected to said door body and slidable within said channel-shaped member.

* * * * *